United States Patent [19]

Bice, Jr

[11] 4,308,424

[45] Dec. 29, 1981

[54] SIMULATED STEREO FROM A MONAURAL SOURCE SOUND REPRODUCTION SYSTEM

[76] Inventor: Robert G. Bice, Jr, 4091 Deerwood Pkwy., Smyrna, Ga. 30080

[21] Appl. No.: 139,854

[22] Filed: Apr. 14, 1980

[51] Int. Cl.[3] ..... H04R 5/04

[52] U.S. Cl. ..... 179/1 GP; 179/1 J; 369/87

[58] Field of Search ..... 179/1 GP, 1 J; 369/87

[56] References Cited

U.S. PATENT DOCUMENTS

| | | | |
|---|---|---|---|
| 2,942,070 | 6/1960 | Hammond et al. | 369/87 |
| 3,219,757 | 11/1965 | Palladino | 179/1 GP |
| 3,670,106 | 6/1972 | Orban | 179/1 GP |
| 3,761,631 | 9/1973 | Ito et al. | 179/1 GP |

*Primary Examiner*—Robert L. Richardson
*Assistant Examiner*—Edward L. Coles
*Attorney, Agent, or Firm*—Newton, Hopkins & Ormsby

[57] ABSTRACT

A source of monaural sound such as a radio receiver or record player provides an audio signal which is fed along parallel paths to a like number of speakers. In one or more paths there is a control which imparts amplification or gain to the signal. In the other path, however, a frequency dependent amplitude variation and phase delay means is interposed in the circuit. It is the purpose of this means to vary the amplitude response of that signal to introduce a bass boost of about a factor of two and a treble cut of about a factor of ten and to vary the phase shift of that signal to introduce from about a 180° to about 225° phase lag to the monaural signal, the amplitude response and phase lag being a function of the frequency of the signal, to impart a simulated stereo effect to the sound as heard from the plurality of speakers.

16 Claims, 5 Drawing Figures

SIMULATED STEREO FROM A MONAURAL SOURCE SOUND REPRODUCTION SYSTEM

BACKGROUND OF THE INVENTION

1. Field of the Invention

This invention relates to a simulated stereo from a monaural source sound reproduction system and more particularly to a method and apparatus for creating a stereo-like sound effect from a monaural signal.

2. Description of the Prior Art

A stereo sound effect is produced by ones sensing the direction of the arrival of different sounds through sensing the small differences between the amplitude and phase of the sounds at the locations of the left and right ears. By the stereo effect in sound reproduction it is meant the effect which allows determination of the directions of arrival of sounds by the above means when two independent sound sources are utilized. By the quadraphonic effect in sound reproduction it is meant the effect which allows the determination of the directions of arrival of sounds by the above means when four independent sound sources are utilized. By monaural information or signal it is meant sound information which results at only one ear or identically at both ears and thereby lacks the phase and amplitude difference information necessary to determine the direction of arrival of sound.

Monaural information or signal is available from many sources. If sound is converted into a corresponding electrical signal by a single microphone, then the resulting signal contains monaural information, since, upon reproduction, insufficient information is present in the reproduced sound for the listener to determine the direction of arrival of the various sounds. In like manner, if the sound is converted into corresponding electrical signals by more than one microphone and the resulting electrical signals are combined directly into a single means of transmission or onto a single means of recording, the resultant signal contains no directional information to allow the listener to determine the direction of arrival of the sounds upon reproduction. Examples of such monaural information are the ordinary telephone sound output, the sound output of ordinary amplitude modulated broadcast radio and the sound output of ordinary broadcast television.

In the past there have been attempts to produce simulated stereo sound effects from monaural signals. Some attempts to create directional effects from monaural information have utilized monaural sound reproduced at one speaker slightly before the same sound is reproduced at another speaker, thereby producing a directional effect together with an echo. Other previous attempts to create directional effects from monaural information have utilized monaural sound reproduced at one speaker with the same sound reproduced at another speaker but with approximately a 180° phase shift at all sound frequencies between the two speakers and with little amplitude difference between the sound generated by the two speakers. This results in a noticable "buzz" or "fuzziness" at various frequencies in the reproduced sound, depending on the speaker separation and the relative location of the listener and the speakers. Many listeners find the echo or fuzziness objectionable.

SUMMARY OF THE INVENTION

Briefly described, the apparatus of the present invention includes a single monaural sound source, such as a conventional A.M. radio, the audio signal from a television set or a record player which develops a single monaural signal, to which is connected through individual circuits or channels two or more transducers, such as speakers or ear phones.

In one or more circuits or channels, there is an audio amplifier and a gain or volume control so that one or more transducers reproduces the monaural signal, as originally fed to it.

In the other circuit is a resonant circuit having a parallel resonance and a different series resonance so that it is frequency responsive to introduce an amplitude variation of a factor of about two bass boost and a factor of about ten treble cut and a phase delay to the signals of from about 180° to about 225°, depending upon the frequency of the signal. There is also an audio amplifier and volume control for the circuit.

The first embodiment of the apparatus discloses a simulated stereo system having a single monaural source driving two individual channels provided with individual speakers speakers, each having an individual audio amplifier and volume or gain control. The two speakers are to the front and to either side of the listener. One of the speaker channels is provided with an individual resonant circuit which individually varies the delay or phase shift and shapes the individual amplitude of the signal going to its speaker.

The second embodiment of the apparatus discloses a simulated quadrophonic system having a single monaural source driving four individual channels provided with individual speakers, each having an individual audio amplifier and volume or gain control. Two speakers are in front of the listener and two behind the listener. One of the front speaker channels is provided with an individual resonant circuit which individually varies the delay or phase shift and shapes the individual amplitude of the signal going to its speaker as in the stereo system described above.

The process of the present invention includes:

1. producing via one of two independent sound channels a monaural signal unchanged and with the volume appropriately adjusted to a level comfortable for the listener;

2. producing via the second of the two independent sound channels the monaural signal, as modified in accordance with the principles of the invention, to produce phase delays and amplitude changes which vary in frequency in a specified manner and adjusting the volume of the second channel such that the listener perceives sounds in the lower middle portion of the audio range (approximately 2500 Hz) to have the same volume level in both channels;

3. arranging the speakers of the two independent sound channels with respect to the listener in the manner utilized in actual stereo sound production systems with:

(a) the two speakers separated and in front of the listener;

(b) with one speaker producing the unmodified monaural sound; and (c) with the second speaker producing the modified monaural sound adjusted for phase and amplitude;

4. the monaural information or signal in the second channel is modified by generating a frequency dependent phase delay in the information or signal which results in:

(a) opposite phase in the monaural sound produced at the speakers of the two independent sound channels at some low and at some high audio frequency;

(b) a phase difference between the monaural sound produced at the speakers of the two independent sound channels which is greater than 180° at some frequency between the aforesaid low and high audio frequencies described in 4(*a*) above;

(c) a phase difference between the monaural sound produced at the speakers of the two independent sound channels which is less than 180° at frequencies less than the aforesaid low frequency and is also less than 180° at frequencies greater than the aforesaid high frequency described in 4(*a*) above.

5. In addition, in accordance with the process of the invention, the monaural information in the second channel is also modified by generating a frequency dependent amplitude variation in the information or signal which results in:

(a) a pronounced amplitude peak in the monaural sound produced at the speaker of the second channel as compared to the monaural sound produced at the speaker of the first channel at the aforesaid low frequency described in 4(*a*) above;

(b) a continuous reduction in the amplitude of the monaural sound produced at the speaker of the second channel as compared to the monaural sound produced at the speaker of the first channel, as the frequency is increased from the aforesaid low to the aforesaid high frequency described in 4(*a*) above;

(c) an adjustment of the frequency independent volume controls of the two independent channels to provide equally perceived volume of the monaural sound from the speakers of the two independent sound channels for an audio frequency in the lower middle audio frequency range between the aforesaid low and high frequencies described in 4(*a*) above; and (d) a pronounced amplitude volume reduction in the monaural sound produced at the speaker of the second channel as compared to the monaural sound produced by the speaker of the first channel at the aforesaid high frequency described in 4(*a*) above.

With respect to the production of simulated directional effects from monaural information with four independent sound channels, in accordance with the process of this invention, is:

1. to arrange two of the independent sound channels as described above complete with the introduction of the frequency dependent phase delay and amplitude shape in one channel as described above;

2. to produce via the remaining two independent sound channels the monaural signal unchanged and with the volume appropriately adjusted in the remaining two channels to increase the naturalness and apparent depth and width of the sound production area as perceived by the listener;

3. to array the speakers of the four independent sound channels with respect to the listener in the manner utilized in actual quadraphonic sound production systems with:

(a) the two speakers separated and to the front of the listener producing the unmodified monaural sound at one speaker and the monaural sound modified at the second speaker and with the relative volume of the sound of the two speakers balanced, as described for the two independent sound channel arrangement described above; and (b) the two speakers separated and to the rear of the listener producing unmodified monaural sound with the relative volume of the sound of the two speakers adjusted to enhance the naturalness and apparent depth and width of the sound area as perceived by the listener.

Accordingly, it is an object of the present invention to provide an apparatus for producing a simulated stereophonic output from a monaural input, the apparatus being inexpensive to manufacture, durable in structure and efficient in operation.

Another object of this invention is to provide an improved process and apparatus for producing simulated directional effects from monaural information in a manner such that unpleasant effects are minimized and the resulting signals are pleasant and realistic.

It is another object of this invention to provide an improved process and apparatus for producing simulated directional effects from monaural information using a minimum amount of additional equipment.

It is another object of this invention to provide an improved process and apparatus for producing simulated directional effects with enhanced naturalness and increased apparent depth and width of the sound production area from monaural information using a minimum amount of additional equipment.

It is another object of this invention to provide an improved process and apparatus for producing sound from monaural information in such a manner as to create the illusion that individual sources of sounds with different frequency and amplitude components are arriving at the listeners' locations from different directions with not all of the sounds arriving from the same direction.

Other objects, features and advantages of the present invention will become apparent from the following description when taken in conjunction with the accompanying drawings wherein like characters of reference designate corresponding views throughout the several views.

DESCRIPTION OF THE PREFERRED EMBODIMENTS

Figure 1:
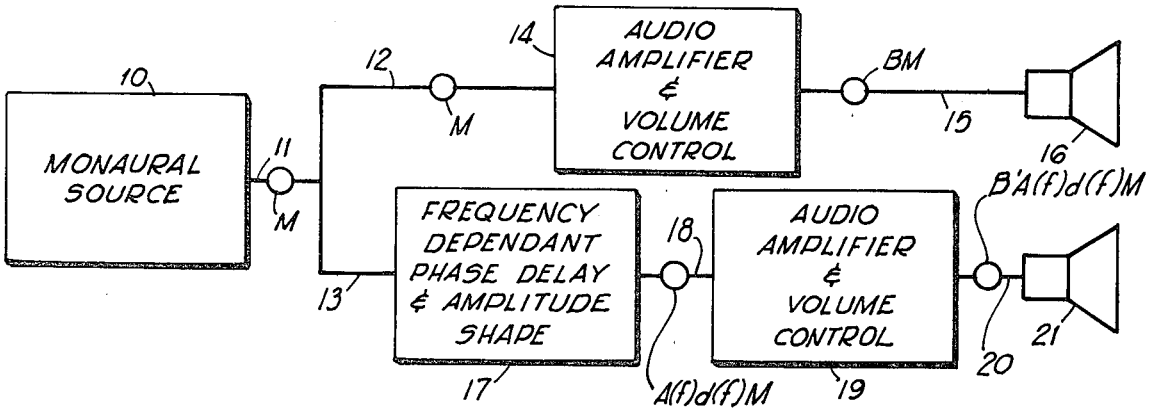
FIG. 1 is a schematic diagram of an apparatus capable of producing sound at two speakers in accordance with the principles of this invention.

Referring now in detail to the embodiments chosen for purpose of illustrating the present invention, numeral 10 in FIG. 1 denotes a monaural sound source, such as an A.M. radio, the audio signal from a television set or a record player. The audio signal, denoted by M, is fed from source 10, via line 11 to lines 12 and 13 of two separate channels or circuits. The signal M of line 12 is then fed along one channel to an audio amplifier and volume or gain control 14 which produces the amplified signal BM. This signal BM is fed, via line 15 to a transducer, such as speaker 16 or one ear phone of a pair of ear phones (not shown).

The signal M is also fed, via wire 13, to a phase delay and amplitude shaping means 17 and, thence, as signal A(f)d(f)M, via wire 18 to an audio amplifier and volume control means 19. From the means 19 the signal B'A(f)d(f)M is fed, via line 20, to a transducer, such as speaker 21 or the other ear phone of a pair of ear phones (not shown).

In FIG. 1, source 10 provides electrical signals M containing monaural information. The signal M is input directly in unmodified form to audio amplifier and volume or gain control means 14 which operates in a manner well known by those skilled in the art. The signal M is also input directly to the frequency dependent phase delay and amplitude shaping means 17 where the monaural information is phase delayed and amplitude shaped as a function of frequency.

The output of the phase delay and amplitude shaping means 17 is the signal A(f)d(f)M, where A(f) denotes the amplitude shape as a function of frequency and where d(f) denotes the phase delay as a function of frequency. The product A(f)d(f)M denotes the results of the operation of the phase delay and amplitude shape means 17 on the monaural signal M. The output A(f)d(f)M of the phase delay and amplitude shape means 17 is input to the audio amplifier and volume control means 19 which operates in a manner well known by those skilled in the art.

The output of the audio amplifier and volume control means 14 is the signal BM where B denotes the volume adjustment to signal M in that channel. The value B is preferably adjusted by the listener using an individual manually operable volume or gain control in means 14 to produce a comfortable audio volume level from the signal BM. The audio amplifier and volume control means 14 makes no modification to the signal other than volume adjustment.

The monaural signal with volume adjustment BM is converted to an audible signal by transducer or speaker 16. The output of the audio amplifier and volume control means 19 is the signal B'A(f)d(f)M where B' denotes the volume adjustment to signal A(f)d(f)M in the second channel. The value B' is preferably adjusted such that the volume of the audio signal with phase delay and amplitude shape, B'A(f)d(f)M, as perceived by the listener is the same as the volume of the unmodified monaural signal, BM, as perceived by the listener, for some frequency in the lower middle portion of the audible spectrum, preferably in the range of 2000 to 3000 Hz. The monaural signal with phase delay, amplitude shaping and volume adjustment, B'A(f)d(f)M, is converted to an audible signal by transducer or speaker 21. The transducers or speakers 16 and 21 are separated and directed as for conventional stereo operation with the two speakers preferably in front and on opposite sides of the listener.

Figure 4:
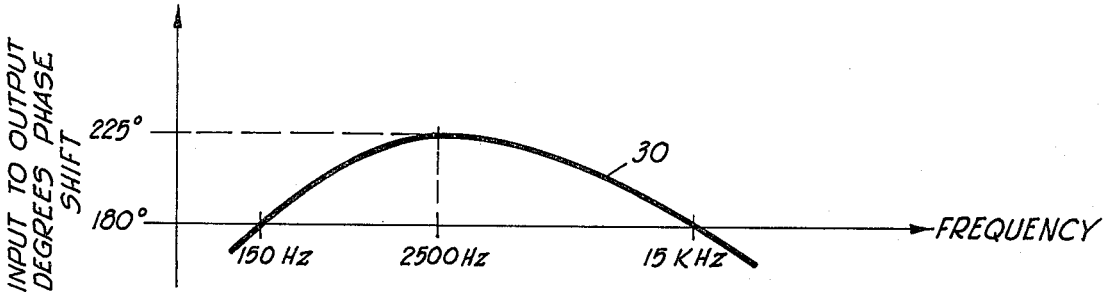
FIG. 4 is a graph illustrating the phase delay versus frequency characteristic required in the apparatus shown in FIGS. 1 and 2 and produced by the apparatus in FIG. 3.
Figure 5:
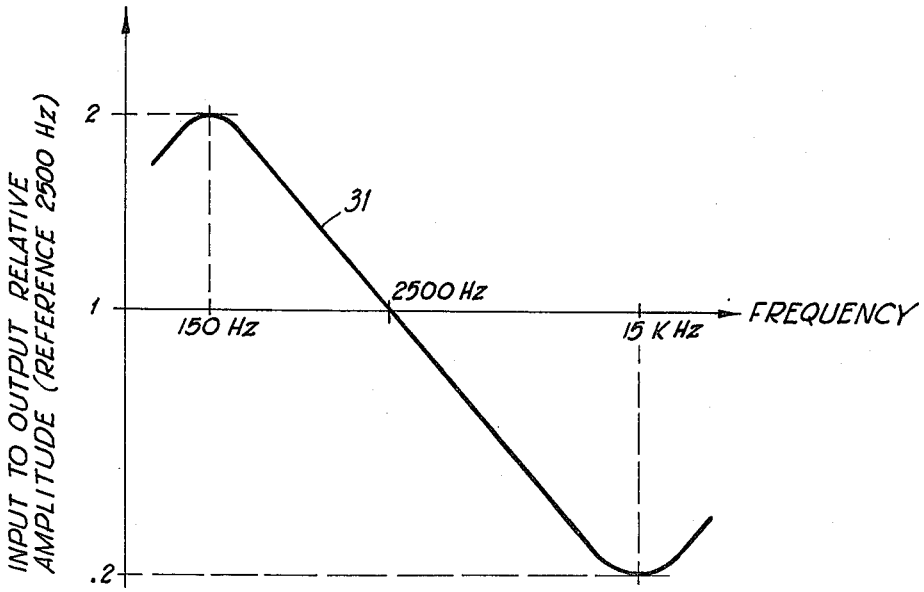
FIG. 5 is a graph illustrating the amplitude response versus frequency characteristic required in the apparatus shown in FIGS. 1 and 2 and produced by the apparatus in FIG. 3.

Referring now to FIGS. 1, 4 and 5, the monaural signal M is audible in unmodified form except for adjustment B of the volume of the sound from the transducer or speaker 16 and the modified monaural signal B'A(f)d(f)M from transducer or speaker 21 is audible with phase delay d(f) as shown in FIG. 4, with amplitude shape A(f), as shown in FIG. 5, and with a volume adjustment B' to balance between the volume of the sounds of the transducers or speakers 16 and 21, as perceived by the listener, in the lower portion of the middle of the audible spectrum.

Under these conditions, an apparent directional effect is observed for sounds emanating from the two transducers or speakers 16 or 21 and sounds of different frequencies are perceived by the listener to emanate from different positions with respect to the location of the listener to the two transducers or speakers 16 and 21. The sounds may be perceived to emanate from the position of either speaker 16 or 21, from various locations between the two transducers or speakers 16 and 21 or from positions near either speaker but not between the two transducers or speakers 16 and 21. The perceived location for a particular sound depends on both the largest amplitude component at a given frequency of the sound and the spectral distribution of the lesser amplitude components of the sound. The mechanism of such effects is not totally understood.

A true stereo effect is produced by slight phase delays and amplitude variations between the two transducers or speakers 16 and 21 in a manner similar to but different from that described above since the stereo effect does not involve frequency dependence, directly. However, sound, produced by apparatus utilizing the principles of this invention, exhibits apparent directional properties similar to those observed for true stereo operation. The observed or apparent stereo effect thus produced is not claimed to be a stereo effect, since the monaural signal contains no directional information, but the listener does perceive a pleasing directional effect which adds naturalness, depth, width and realism to the audible monaural signal.

The phase delay and amplitude shape variations, as shown in FIGS. 4 and 5, are not absolute. However, a phase delay of 180° between the two transducers or speakers 16 and 21 at frequencies in the low portion of the lower audible range and the upper portion of the upper audible range is usually necessary with a phase delay different from but greater than 180° between the two frequencies being required.

It appears that the maximum difference from 180° should occur near the middle portion of the audible range, preferably in the range of 2500 to 8000 Hz; that the phase difference should be relatively constant over this range; that the phase delay variation from 180° should be large, a prefered value being approximately an additional 45° i.e., 225°; and that the phase delay should not exceed an additional 180°, thereby preventing an in-phase condition which should be avoided.

With respect to amplitude, the amplitude shape in the second sound channel i.e., the channel producing the modified monaural information through transducer or speaker 21, should have an amplitude peak occuring near the frequency of the low frequency 180° phase delay between the two transducers or speakers 16 and 21. Further, the amplitude in the second sound channel should decrease at frequencies in the upper audible spectrum as compared to the amplitude at the low frequency peak in the channel, with a prefered value of the voltage loss between the high frequency and low frequency amplitudes being in the range of from about factor of 4 to a factor of 10 and with the amplitude change being generally linear to produce a smoothly varying amplitude as a function of frequency.

In a two speaker or channel system, the unmodified monaural signal should emanate from only one transducer or speaker: i.e., speaker 16, with the modified monaural signal emanating only from the other transducer or speaker 21, and with the volume from the two transducers or speakers 16 and 21 as perceived by the listener balanced for frequencies in the lower portion of the middle of the audible range.

By the term phase delay, it is meant a change in the phase between two signals of the same frequency, such that one signal occurs very slightly after, or before, the other signal. This delay between the signals may be variable with frequency. Such a phase delay is not to be confused with the result of a simple time delay between the two signals in which the phase delay between the two signals changes continuously with frequency in a linear, monotonic fashion. The use of a simple time delay in the type of system described above results in an echo with no directional effect and is specifically not a feature utilized in the apparatus described herein.

Figure 2:
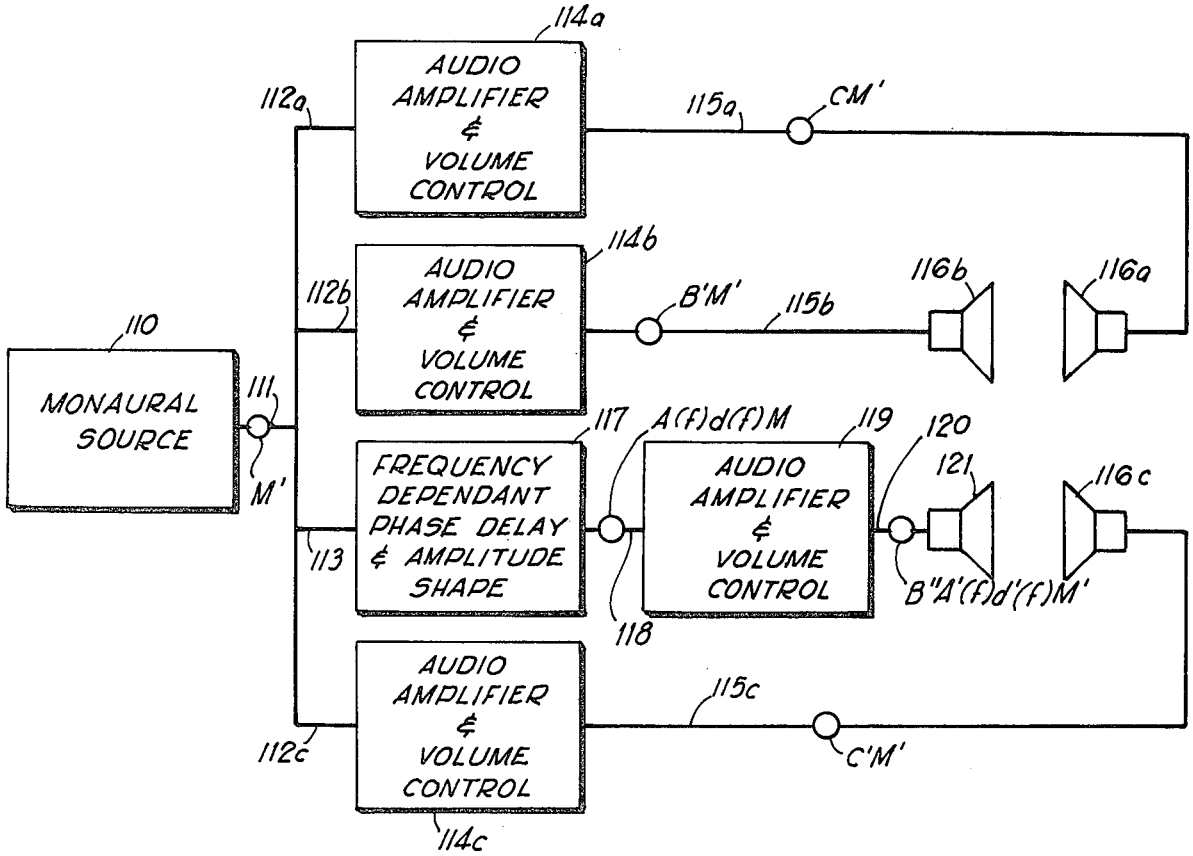
FIG. 2 is a schematic diagram of an apparatus capable of producing sound at four speakers in accordance with the principles of this invention.

In the second embodiment shown in FIG. 2, a source 110 provides electrical signals M' containing monaural information. The signal M' is input directly in unmodified form to a multiplicity of audio amplifiers and volume or gain control means 114*a*, 114*b*, 114*c* via separate channels including lines 111, 112*a*, 112*b* and 112*c*. The signal M', via line 113, is also input directly into the frequency dependent phase delay and amplitude shaping means 117 where the monaural information is phase delayed and amplitude shaped as a function of frequency; e.g., preferably as shown in FIGS. 4 and 5. The phase delay and amplitude shaping means 117 operates the same as the phase delay and amplitude shaping means 17 described above and produces the signal A'(f)d'(f)M' which is essentially the same delay and shaping as that introduced by the phase delay and amplitude shaping means 17. The output A'(f)d'(f)M' of the phase delay and amplitude shaping means 117 is the input to audio amplifier and volume control means 119 which operates in a conventional way.

The output of audio amplifier and volume control means 114*b* is the signal B'M' where B' denotes the volume adjustment to the signal M' in that channel. The value B' is preferably adjusted to a comfortable volume level by the listener using the volume control means in 114*b*. The monaural signal with volume adjustment B'M' is converted to an audible signal by transducer i.e., speaker 116*b* in the conventional way.

The output of the audio amplifier and volume control means 119 is the signal B''A'(f)d'(f)M' where B'' denotes the volume adjustment to the signal A'(f)d'(f)M' in the channel of line 113. The value B'' is preferably adjusted by the listener using the volume control in means 119 such that the volume of the signal B''A'(f)d'(f)M' as perceived by the listener is the same as the unmodified monaural signal, B'M', as perceived by the listener for some frequency in the lower middle portion of the audible spectrum, preferably in the range of 2000 to 3000 Hz. The monaural signal M' with phase delay, amplitude shaping and volume adjustment, B''A'(f)d'(f)M', is converted to an audible signal by transducer or speaker 121 in a conventional manner.

When speakers are used as the transducers, the speakers 116*b* and 121 are placed forward of the listener and separated and directed as for the forward two speakers in conventional quadraphonic operation.

The output of audio amplifier and volume control means 114*a* is the signal CM' where C denotes the volume adjustment to the signal M' in the channel of line 112*a*. The output of audio amplifier and volume control means 114*c* is the signal C'M' where C' denotes the volume adjustment to the signal M' in the channel of line 112*c*. The values C and C' are preferably adjusted by the listener after the values B' and B'' have been adjusted. The values C and C' are preferably adjusted together, maintaining approximately equal value for C and C', to enhance the apparent depth and width of the sound production area and the sound naturalness as perceived by the listener when all four sound channels are operating and are adjusted as described above.

The monaural signals with volume adjustment CM' and C'M' are converted to audible signals by speakers 116*a* and 116*c*, respectively, in a conventional manner. The speakers 116*a* and 116*c* are placed to the rear of the listener and separated and directed as for the two rearward speakers in conventional quadraphonic operation.

The operation of the two audio channels via lines 115*b* and 120 to the forward two speakers, 116*b* and 121, is the same as that described for the similar arrangement for the two channels of FIG. 1. The addition of the audio signals from the remaining two audio channels to rearward speakers 116*a* and 116*c* via lines 115*a* and 115*c*, respectively, enhances the observed directional effect by making the sound more natural as perceived by the listener and by adding depth and width to the sound production area as perceived by the listener. The monaural sound thus may be perceived to be more natural and to emanate from locations over a greater range of width and depth than that perceived by the listener for the arrangement in FIG. 1. The variation in perceived locations of the various sounds is dependent on the same factors as those described for FIG. 1.

The mechanism of the enhancement of the naturalness of the sound and the increase of the depth and width of the sound production area is not totally understood. The directional effects are similar to those described for the arrangement in FIG. 1, as are the requirements for the characteristics in the phase delay and amplitude shaping and volume adjustment for the forward two speakers 116*b* and 121. The added realism and naturalness are dependent on the adjustment of the volume of the sound from the two rearward speakers 116*a* and 116*c* and careful adjustment is required to realize the full potential of the arrangement in FIG. 2. The rear speakers 116*a* and 116*c* appear to add additional audio paths to the listener and thereby enhance the apparent stereo effect by providing sound at the two ears of the listener with additional phase delay and amplitude variations, similar to the sounds that would impinge on the ears of the listener were he actually present at the location of the point of generation of signal M' in FIG. 2.

It is emphasized that the listener, to obtain the most satisfying experience from the four sound channel mode of operation, must not make the level adjustment to the rear speakers 116*a* and 116*c* any higher than necessary to achieve the apparent sound production area expansion phenomemon or else the effect is minimized by making the rear speakers 116*a* and 116*c* a perceived separate sound source.

Curve 30 of FIG. 4 and curve 31 of FIG. 5 show, respectively, the difference in the phase delay in degrees and amplitude shape in voltage ratio, versus logarithmic frequency, between the electrical signals applied to speakers 16 and 21 of FIG. 1 and 116*b* and 121 in FIG. 2, respectively. It has been observed that a maximum in the difference in the phase delay near the middle of the audible range i.e., about 2500 Hz, relative to a phase delay of 180°, provides the most realistic directional effects and that the peak additional delay should be an appreciable fraction of 180°, a desirable additional value being in the range of 30° to 90°. It has also been observed that the decreasing amplitude with increasing frequency characteristic provides the most realistic directional effects when the amplitude shape results in an increase in the amplitude of the low frequency signals from the speaker 21 in FIG. 1 and 121 in FIG. 2, as compared to the low frequency signals from the speaker 16 in FIG. 1 and 116*b* in FIG. 2, respectively and a decrease in the amplitude of the high frequency signals from the speaker 21 in FIG. 1 and 121 in FIG. 2 as compared to the high frequency signals from the speaker 16 in FIG. 1 and 116*b* in FIG. 2, respectively. A desirable value of the amplitude change with frequency provides a voltage ratio in the range of from about 4 to about 10 between the low and high frequency signal amplitudes applied to speaker 21 in FIG. 1.

Figure 3:
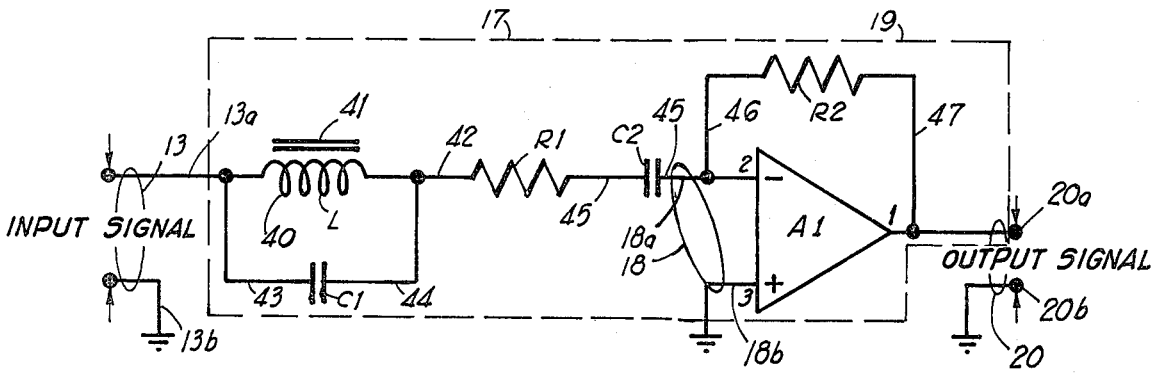
FIG. 3 is a schematic diagram of a circuit producing the phase delay and amplitude response shown in FIGS. 3 and 4 and which may be utilized in the arrangements shown in FIGS. 1 and 2 to produce the frequency dependent amplitude and phase delay characteristics required by the sound channel producing the modified monaural sound.

FIG. 3 illustrates in schematic form a circuit for producing the desired frequency dependent phase delay and amplitude shape characteristics in a monaural signal in electrical form as required in the frequency dependent phase delay and amplitude shape means 17 or 117. While other circuits may be designed to vary the phase shift with amplitude so as to correspond generally to the characteristics described above and as shown in FIGS. 4 and 5, the circuit which I prefer is depicted in FIG. 3 since it is a simple and practical means of generating the signal characteristics utilized in the invention.

In FIG. 3 the frequency dependant phase delay and amplitude shape means 17 is shown as including a resonant circuit having a choke or inductor coil L, provided with a metal core 41. One side of coil L is, thus, connected to the input wire 13*a* of line 13 and the other side thereof to a wire 42. Wire 13*b* of line 13 is grounded to ground G. In parallel with or across the coil 40 is a relatively small value capacitor C1, one side of which is connected, via wire 43 to wire 13*a* and the other side of which is connected by wire 44 to wire 42.

Wire 42 is connected to one side of a resistor R1, the other side of which is connected, via wire 45, to a relatively large capacitor C2. The other side of capacitor C2 is connected via wires 45 and 18*a* to pin 2 of amplifier A1 and via wires 45 and 46 to resistor R2.

Operational amplifier A1, which is operated as an inverting amplifier is arranged with the minus input pin 2 being connected to wire 18*a* and the plus input pin 3 being connected to ground G, via wire 18*b*. The amplifier A1 has a feedback network including a resistor R2, one side of which is connected, via wire 46 to wires 18*a* and 45 and the other side of which is connected, via wire 47 to the output wire 20*a* connected to the output pin 1 of amplifier A1. The wire 20*b* of line 20 is connected to ground G. Wire 20*a* provides the output signal for the audio amplifier and volume control means 19 of FIG. 1 and 119 of FIG. 2.

Since the means 117 is identical to means 17, no detailed description of means 117 is necessary. Operational amplifier A1 operates as an inverting amplifier in a manner well understood by those skilled in the art to produce an output signal which is the input signal at wire 13*a* multiplied by the ratio of the electrical impedance of the operational amplifier feedback network comprised of resistor R2 to the electrical impedance of the input network comprised of inductor coil L, resistor R1 and capacitors C1 and C2.

The circuit action is such that the ratio of the output signal at wire 20*a* to the input signal at wire 13*a* is approximately the ratio of the value of resistor R2 to the value of the resistor R1 near the frequency of series resonance of inductor coil L and capacitor C2, provided that the value of capacitor C2 is very much greater than the value of capacitor C1, a desirable ratio of the value of the capacitor C2 to C1 being between about 50:1 and about 1000:1 and preferably greater than 250:1. The ratio of the output signal at wires 20*a* to the input signal at wire 13*a* at frequencies near the parallel resonance between inductor coil L and capacitor C1 is approximately equal to the ratio of the value of resistor R2 to the effective resistance of this parallel resonant circuit, comprised of inductor coil L and capacitor C1, when the above restriction on the ratio of the values of capacitors C1 and C2 is adhered to.

It will be understood that the effective resistance of the parallel resonant circuit is primarily a function of the "quality factor" of the inductor i.e., coil L, at that frequency and choosing an inductor with a high "quality factor" results in a large effective resistance for the parallel resonant circuit.

The desired amplitude shape is obtained by setting the parallel resonant frequency of inductor coil L and capacitor C1 near the upper limit of the audible range, between about 10 kHz and 20 kHz and preferably approximately 15 kHz, and choosing the ratio of the feedback resistor R2 to the effective resistance of the parallel resonant inductor coil L and capacitor C1 to provide a voltage ratio less than one between the output signal at wire 20*a* and the input signal at wire 13*a*. Furthermore, the series resonant frequency of inductor coil L and capacitor C2 is set near the lower limit of the audible range, from about 50 Hz to about 1000 Hz and preferably approximately 150 Hz, and the ratio of the value of the feedback resistor R2 to the value of the input resistor R1 is chosen to be greater than one, such that the ratio between the output signal at wire 20*a* and the input signal at wire 13*a* obtained (1) at the freqency of series resonance between inductor coil L and capacitor C2 and (2) at the frequency of parallel resonance between inductor coil L and capacitor C1, when taken as a ratio, is in the range of about 4:1 to about 10:1.

Near the series resonant frequency between inductor coil L and capacitor C2 and under the conditions described above for the values of capacitors C1 and C2, a small or no phase delay is generated by the passive components and the phase delay, as indicated by the phase difference between the output signal at wire 20*a* and the input signal at wire 13*a* is the 180° phase delay produced by the action of the inverting configuration of operational amplifier A1. Near the parallel resonant frequency between inductor coil L and capacitor C1, a small or no phase delay is also generated by the passive components and the phase delay as described above is again the 180° phase delay produced by operational amplifier A1.

Thus, the phase delay between these two resonant frequencies varies in a complex manner, increasing in value with increasing frequency to a value greater than the 180° which occurs at the above described series resonant frequency to a peak near the middle of the audible range and then decreasing with increasing frequency to the value of 180° near the above described parallel resonant frequency.

Values of the components in FIG. 5 which have been observed to give desirable results are given in Table I, below:

TABLE I

| | |
|---|---|
| Inductor Coil L | 4 henries |
| Capacitor C1 | 24 picofarad |
| Resistor R1 | 39,000 ohms |
| Capacitor C2 | .68 microfarad |
| Resistor R2 | 470,000 ohms |

It may be observed in FIG. 1 that the apparatus utilized in this invention is similar to a standard stereo reproduction system with the audio amplifier and volume controls 14 and 19 and speakers 16 and 21 in FIG. 1 being provided by the stereo system. The standard stereo system apparatus is augmented by the frequency dependent phase delay and amplitude shape means 17 in one audio channel of the stereo system apparatus and the two stereo system channels, as augmented, are simultaneously provided input from a single monaural source. Since stereo system apparatus of high quality is widely available and the modification means, such as the coil L, capacitors C1, C2, resistors R1, R2, and amplifier A1 are simple, the system is economical and readily manufactured to be implemented.

Typical phase shift and voltages reading for a range of audio frequencies is found in Table II hereof.

TABLE II

| Frequency of the Input Signal in Hz | Amplifier A1 Output Signal in Volts | Phase Change Produced Beyond 180° |
|---|---|---|
| 50 | 4.55 | −19.8° |
| 100 | 4.60 | −5.4° |
| f series = 160 | 4.60 | 0° |
| 300 | 4.55 | +7.2° |
| 500 | 4.38 | +13.0° |
| 700 | 4.18 | +21.0° |
| 1000 | 3.80 | +29.5° |
| 1500 | 3.20 | +37.1° |
| 2000 | 2.76 | +40.3° |
| 2200 | 2.38 | +46.1° |
| 3000 | 2.15 | +47.5° |
| 3500 | 1.88 | +47.5° |
| 4000 | 1.67 | +47.5° |
| 4000 | 1.53 | +46.8° |
| 5000 | 1.38 | +47.0° |
| 6000 | 1.28 | +46.8° |
| 7000 | 1.02 | +43.0° |
| 8000 | 1.00 | +41.4° |
| 9000 | .82 | +34.2° |
| 10000 | .75 | +31.7° |
| 11000 | .69 | +25.2° |
| 12000 | .63 | +17.3° |
| 13000 | .60 | +9.0° |
| f parallel = 14500 | .57 | 0° |

This invention produces realistic directional effects and apparent width and depth in the sound production area from monaural information. Sounds are perceived to arrive from different locations of origin. The continuously varying phase delay and amplitude shape as a function of frequency are thought to be solely responsible for this effect. This effect is similar to the actual stereo effect in which sounds impinge upon the two ears with different delays and different amplitudes due to the placement of the location of the sources of the sounds, the direct path between the sources of the sounds and the ears and the various indirect reflection paths between the sources of the sounds and the ears, all of which functions are a function of the frequencies in the sounds. The use of the variation of the phase delay and amplitude shape between the sound sources as a function of frequency in reproduction of monaural sound provides a pleasing, natural and realistic reproduction of the sound with desirable directional effects.

I claim:

1. Apparatus for producing a simulated stereo signal from monaural signals comprising:

(a) a source of monaural signals;

(b) a plurality of transducers;

(c) channels for feeding said signals from said source respectively to said transducers;

(d) gain control means for adjusting the relative gains of the signals fed to said transducers; and (e) frequency dependent phase change and amplitude shape means in one of said circuits for progressively adjusting, according to the frequency of the signals, the phase in that circuit of the signals fed to one of said transducers with respect to such signals fed to other of said transducers, said means also progressively adjusting, according to the frequency of the signals, the amplitude in that circuit of the signals fed to one of said transducers with respect to such signals fed to other of said transducers.

2. The apparatus defined in claim 1 wherein said phase change means includes a phase delay means for delaying the phase of the signals of one of said transducers with respect to the signals of the other of said transducers by between approximately 180° and approximately 225° through most of the audio range of frequencies of such signals.

3. The apparatus defined in claim 1 wherein said amplitude change means includes an amplitude shape means for changing the amplitude of the signals of one of said transducers with respect to the signals of the other of said transducers by between a factor of 4 and a factor of 10 over the audible frequency range of such signals.

4. The apparatus defined in claim 1 wherein said phase change and amplitude shape means includes a resonant circuit means having a pair of resonant frequencies one being in the low audible range and one being in the high audible range.

5. The apparatus defined in claim 1 wherein said frequency dependent phase change and amplitude shape means includes a coil, a first capacitor in parallel with said coil for forming a resonant circuit means and a second capacitor in series with said resonant circuit means, said resonant circuit means and said second capacitor having a series resonant frequency in the lower audible range and a parallel resonant frequency at a substantially higher audible frequency.

6. The apparatus defined in claim 5 wherein said low audible frequency is from 50 Hz to 1000 Hz and said high frequency being from about 10,000 Hz to about 20,000 Hz.

7. The apparatus defined in claim 1 wherein said phase change and amplitude shape means includes a resonant circuit having a coil and a first capacitor in parallel with each other and a second capacitor in series with said resonant circuit having a series resonant frequency with said second capacitor and a parallel resonant frequency with the said first capacitor, both resonant frequencies being in the audible range.

8. The apparatus defined in claim 1 wherein the ratio of said series resonant frequency to said parallel resonant frequency being between approximately 10:1 and approximately 400:1.

9. The apparatus defined in claim 1 wherein said phase change and amplitude shape means includes a means for introducing a delay of approximately 180° in the frequencies of the signals of one of said channels when said signals are in the low frequency audible range and also when said signals are in the upper frequency audible range and for introducing a phase change greater than about 180° for the frequencies of the said signals between said low frequency audible range and said high audible frequency range.

10. The apparatus defined in claim 9 wherein said delay is greatest between approximately 2500 Hz and approximately 3000 Hz.

11. The apparatus defined in claim 1 wherein said phase change and amplitude shape means includes a means for introducing an amplitude shape in the frequencies of the signals of one of said channels, said amplitude shape producing a maximum in amplitude of the signals in the low frequency audible range, a minimum in the amplitude of the signals in the high frequency audible range, said maxima and minima producing a voltage ratio between the amplitudes of signals in said low frequency and high frequency audible ranges of approximately 4:1 to 10:1 and said amplitude shape decreasing smoothly from said low frequency to said high frequency.

12. The apparatus defined in claim 11 wherein said amplitude shape maxima is in the range of 50 Hz to 1000 Hz and said amplitude shape minima is in the range of 10,000 Hz to about 20,000 Hz.

13. Apparatus for enhancing the natural and realistic production of sound with listener perceived directional effects from monaural information comprising a first transducer for converting electrical signals to sound, a second transducer for converting electrical signals to sound, the first and second transducers being spaced from each other so that the sounds emanating therefrom appear to come from spaced points, means for energizing said first transducer with the signals BM and means for energizing said second transducer with signals B'A(f)d(f)M, wherein M is a signal representing the monaural information, B represents a frequency independent gain factor to the signal to the said first transducer, B' represents a frequency independent gain factor to the signal to said second transducer, A(f) is a frequency dependent amplitude shape factor to the signal to said second transducer, d(f) is a frequency dependent phase delay factor to the signal to said second transducer, where B', A(f) and d(f) act in concert on signal M to provide a signal to said second transducer having frequency independent gain and frequency dependent amplitude shape and phase delay different from the signal fed to said first transducer.

14. Apparatus for enhancing the natural and realistic production of sound with listener perceived directional effects and enhanced width and depth of the sound production area from monaural information comprising a first transducer, a second transducer, a third transducer, a fourth transducer, said first transducer and said second transducer being spaced so that sounds emanating therefrom appear to come from spaced points, said third transducer and said fourth transducer being spaced so that sounds emanating therefrom appear to come from spaced points, said first transducer and said second transducer and said third transducer and said fourth transducer being spaced so that the sounds emanating from said first transducer and second transducer appear to come from spaced points forward of a listener while simultaneously the sounds emanating from said third transducer and said fourth transducer appear to come from spaced points to the rear of the same listener, means for energizing said first transducer with the signals BM, means for energizing said second transducer with the signals B'A(f)d(f)M, means for energizing said third transducer with signals CM, means for energizing said fourth transducer with means C'M, wherein M is a signal representing the monaural information, B represents a frequency independent gain factor to the signal to the said first transducer, B' represents a frequency independent gain factor to the signal to the said second speaker, A(f) is a frequency dependent amplitude shape factor to the signal to the said second transducer, d(f) is a frequency dependent phase delay factor to said second speaker where B', A(f) and d(f) act in concert on signal M to provide a signal to said second speaker with frequency independent gain and frequency dependent amplitude shape and phase delay different from the signal to the said first transducer, C represents a frequency independent gain factor to the signal to the said third transducer, C' represents a frequency independent gain factor to the signal to the said fourth transducer and the said monaural signal source is the same for the said apparatus providing the signals to the transducers.

15. Process for enhancing the natural and realistic production of sound by imparting listener perceived directional effects from monaural information comprising disposing first and second speakers in spaced positions, energizing said first speaker with the signals BM and energizing said second speaker with signals B'A(f)d(f)M, wherein M is a signal representing the monaural information, B represents a frequency independent gain factor to the signal for said first speaker, B' represents a frequency independent gain factor to the signal to said second speaker, A(f) is a frequency dependent amplitude shape factor to the signal for said second speaker, d(f) is a frequency dependent phase delay factor for the signal to said second speaker, where B', A(f) and d(f) act in concert on signal M to said second speaker to impart a frequency independent gain and frequency dependent amplitude shape and phase delay to such signal, different from the signal for said first speaker.

16. Apparatus for producing sound of the type having a source of monaural signals, a plurality of transducers and individual circuits connected to said source and said transducers for transmitting simultaneously said signals individually to said transducers, the improvement comprising means in one of said circuits for introducing into the signals of said one of said circuits a frequency dependent phase change and an amplitude shape change which is the function of the frequency of said signals.

* * * * *